United States Patent [19]

Britton

[11] 4,034,158

[45] July 5, 1977

[54] QUADRAPHONIC PASSIVE FOUR-CHANNEL DECODER

[76] Inventor: Berdette O. Britton, P.O. Box 18044, Dallas, Tex. 75218

[22] Filed: Dec. 5, 1972

[21] Appl. No.: 312,307

[52] U.S. Cl. ..... 179/1 GQ; 179/100.4 ST

[51] Int. Cl.[2] ..... H04R 5/00

[58] Field of Search .... 179/16 Q, 15 BT, 100.4 ST, 179/100.1 TD

[56] References Cited

UNITED STATES PATENTS

| | | | |
|---|---|---|---|
| 3,397,286 | 8/1968 | Prewitt | 179/1 G |
| 3,697,692 | 10/1972 | Hafler | 179/1 GQ |
| 3,958,085 | 5/1976 | Barber et al. | 179/1 GQ |

OTHER PUBLICATIONS

Dyna Quadraphonic Type II High Fidelity Magazine, Feb. 71.

A New Quadraphonic System by Hafler, Audio Magazine, July 1970.

*Primary Examiner*—Douglas W. Olms
*Attorney, Agent, or Firm*—Limbach, Limbach & Sutton

[57] ABSTRACT

A quadraphonic decoder is described for providing connections between a stereo amplifier and four loudspeakers. Two signals each comprising in-phase and out-of-phase components are applied from the amplifier to the speakers by the decoder so that these four separable components are each reproduced by a different loudspeaker. Means are provided for trapping out-of-phase signal components off the speakers reproducing in-phase signal information. A different network is provided to allow the speakers reproducing out-of-phase signals to operate independently. Means are also provided for damping out all but the out-of-phase signal components on the speakers, so that the presence of such signal components may be detected.

1 Claim, 2 Drawing Figures

QUADRAPHONIC PASSIVE FOUR-CHANNEL DECODER

BACKGROUND OF THE INVENTION

This invention relates to a system and method for processing signals representing sound or music having multiple amplitude and/or phase differentiated components so that when the signals are decoded they may be separated into these components and the separated components be selectively applied to acoustic transducers.

The normal experience in listening to music or sound in live performance is to receive the sound from a multitude of sound source locations, including direct and reflected sound waves. In addition, if the sound source moves there is a frequency shift corresponding to the doppler frequency shift or effect. However, when recorded music or sound is reproduced, the number of sound sources is limited by the number of available loudspeakers.

In the common systems used to this time and for which the majority of persons own receiving equipment, there are two loudspeakers or acoustic transducers spaced apart to give the effect of the music emanating from any point between the two speaker locations. But with only two loudspeakers, the listener is deprived of certain sound signal information which would be received in a live performance, and therefore some of the effect of the live performance is lost. Particularly, many cues to the distance and location and scope of a sound source are dependent upon the information received in the reverberant sound field. However, most of this field cannot be provided in a two-loudspeaker system. It is therefore desirable to provide a system whereby the sound signals are applied to at least four loudspeakers so that both the direct and reverberant sound field are present and the effect of the sound or music is of that being generated in a spacial continum. A further effect is to effectively surround the listener with sound, as though he were sitting in the middle of the performing group. But although many people appreciate the enhanced sound derived from the four speakers playing different portions of a program, most have too much invested in stereo reception equipment to be willing to replace it with equipment for receiving and amplifying four discrete sound signals.

To this end, techniques have been developed for combining or matrixing the four recorded signals into two signals in an amplitude and phase determined relationship. Ordinarily, the two signals to be applied to the rear speakers are combined into the two signals intended for application to the front speakers which remain separate so that such recordings are compatible with stereophonic equipment.

SUMMARY OF THE INVENTION

It is an object of the invention to provide means to decode the two signals as received and amplified by conventional stereophonic equipment and apply the amplitude and phase differentiated components thereof to four separate loudspeakers.

Devices are known in the prior art which "synthesize" the received and amplified matrixed signals, i.e. applying the in-phase signal components to the two primary speakers (used for stereo) and the out-of-phase components to the secondary speakers (added for quadraphonic sound). But such units do not trap the out-of-phase sound components out of the primary speakers, nor provide any signal differentiation between the two rear speakers. Further, the loudspeaker outputs may or may not be aligned with four channel signals originally recorded.

It is an object of this invention to provide a decoder having separation between the primary and secondary pairs of receivers and separation between each speaker of each pair, so that the sound is broadcast in four different quadrants as it was recorded.

A quadraphonic decoder is described for providing connections between a stereo amplifier and four loudspeakers. Two signals each comprising in-phase and out-of-phase components are applied from the amplifier to the speakers by the decoder so that these four separable components are each reproduced by a different loudspeaker. Means are provided for trapping out-of-phase signal components off the speakers reproducing in-phase signal information. A differential network is provided to allow the speakers reproducing out-of-phase signals to operate independently. Means are also provided for damping out all but the out-of-phase signal components on the speakers, so that the presence of such signal components may be detected.

DESCRIPTION OF A PREFERRED EMBODIMENT

Figure 1:
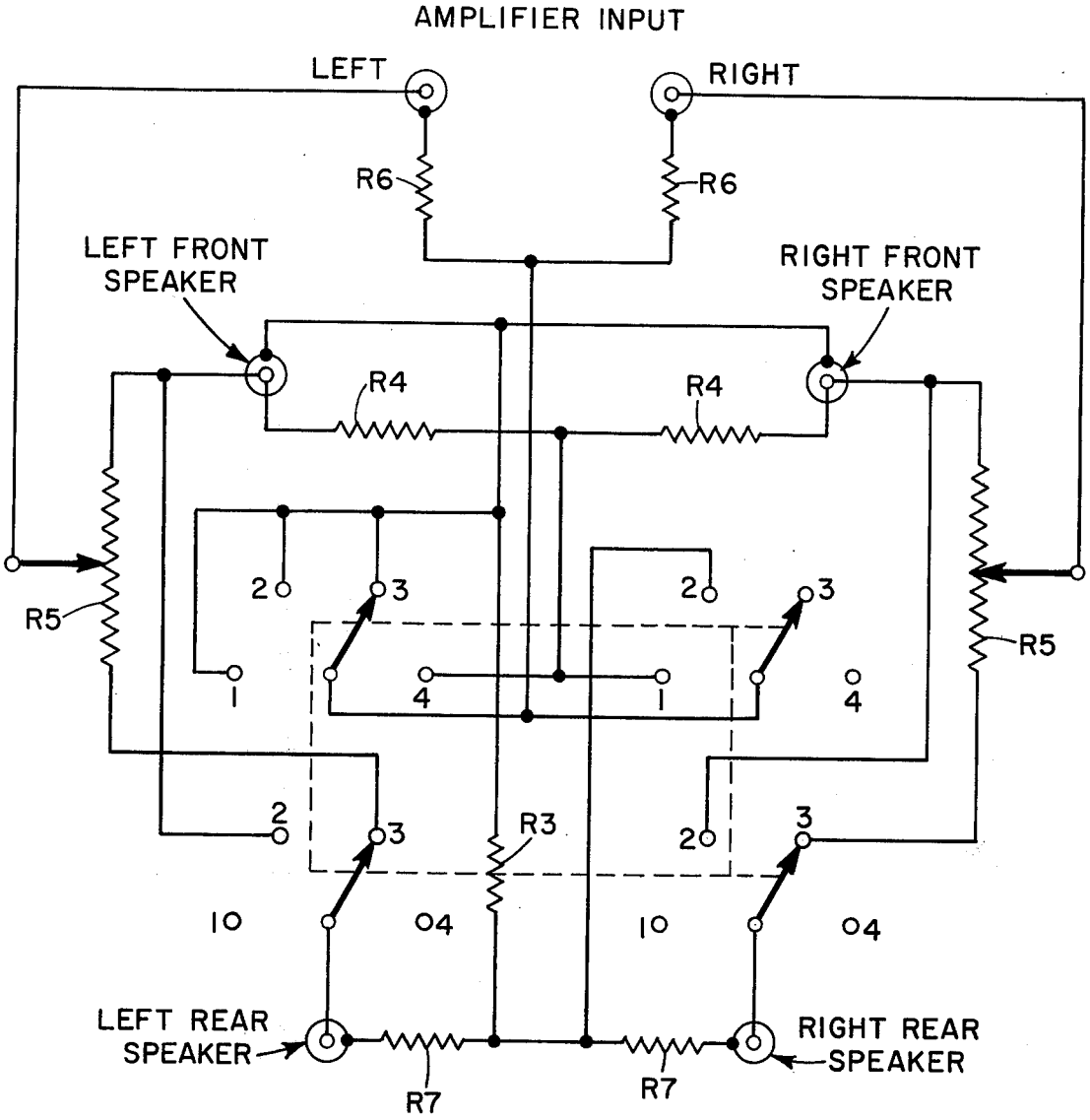
FIG. 1 is a schematic diagram of a preferred embodiment of a passive decoder in accordance with this invention, with the switch wipers in appropriate positions for decoding quadraphonic sound information.

FIG. 1 shows an exemplary embodiment of a device for decoding 4 channel quadraphonic sound information recorded on two channels. The encoding technique relies on a relationship of phase shift and amplitude as is well known in the art. This decoding device comprises a phase and amplitude conscious network to decode or "dematrix" the encoded program material. In the standard recording technique with which this decoding device is intended to be compatible, the two back channels of a four channel program are mixed into the two front channels in such a predetermined way that the program material can be decoded or reconstructed back into four channels at a later time. The advantage of such an encoding technique is to be able to handle four channels program material as though it was in a two channel stereo program so that such four channel programming may be played back using regular stereo amplification devices. A passive decoder such as disclosed herein is then sufficient as coupled between the two amplifier output and the inputs to the group of four speakers to decode the program material into four separate channels.

In considering this exemplary embodiment, it should be remembered that the audio signals from the two amplifier outputs each include in-phase and out-of-phase components; the in-phase components are to be reproduced by the front speakers and the out-of-phase components by the rear speakers. Optimum separation is obtained by damping out cross-talk to the maximum possible extent.

Figure 2:
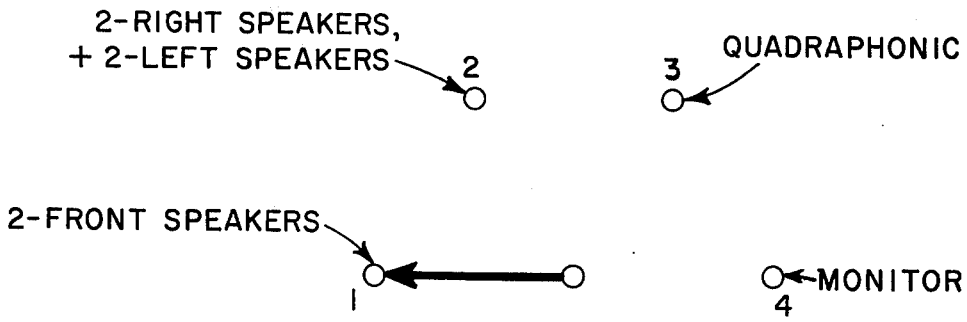
FIG. 2 is an illustration of the control switch used in conjunction with the decoder of FIG. 1.

The operation of the device will now be explained with reference to each of the four switch positions of control switch 5. The decoding device of FIG. 1 includes a four position having four separate sets of contacts and four wipers, the four wipers being ganged together to always be set to the same positions. The functions provided in the four positions are indicated to FIG. 2.

Considering the position 1, in which the two front speakers are active and the two rear speakers are inactive, an operational mode most commonly used in listening to monophonic sound, it can be seen that the high side of the amplifier output is connected through the wiper arm and resistance of potentiometer R5 to the high side of the front speakers. The low side of the front speaker is connected through switch position 1 and the switch wiper arm to the junction point between resistors R6 which connect the low side of the amplifier output jacks to decoder. The resistors R6 are utilized to isolate the input ground lines sufficiently to allow this device to function with most floating ground amplifiers. The junction between resistors R6 is referred to as decoder ground or input ground and unless otherwise noted may be considered as system common or ground. The entire audio signal is applied from each amplifier output to its related from speaker; and as these speakers have separate hot inputs each related to ground, the in-phase components of the applied audio signals are separately reproduced by the two speakers.

The control switch in position 1 leaves the high side of the rear speakers disconnected from the audio outputs, so that no signal is applied thereto. To prevent a sudden change in output volume in this switch position due to the fact that the rear speakers are not loading the amplifier outputs, the center tap between two resistors R4 (whose other functions are explained below) connected between the high or hot sides of the front speaker inputs is connected to ground through position 1 of the right front speaker switch. These resistors provide a load on this amplifier comparable to the rear speakers (whose connections are floating in this switch position).

Thus, the system performs just as though it were a stereo system. If the wiper arm of the potentiometer R5 (whose functions are explained below) were moved all of the way to the end closest to the high side speaker input, the circuit itself would operate substantially as though the decoder were not in it.

In switch position 2 (i.e., 2 right speakers + 2 left speakers, FIG. 2) audio signals are applied to both the left and right pairs of speakers; the same information is thus broadcast over the right pair of speakers (i.e. front and rear) and the left pair of speakers. It can be seen that the wipers of the ganged switch 5 connect the high side of each of the rear speakers to a line tied to the high side of the front speakers, so that the same audio signal is applied to the high side of both pairs of speakers. The low side of the front speakers is again connected to the system input group through switch contact 2. The low side of the rear speakers is connected to this same input ground through a center tap between resistors R7 through switch contact 2. As the signals applied to both the front and back speaker of each left (right) pair are referenced to ground, separate audio signal information is reproduced by the left and right pairs. Thus, the front and rear pairs of speakers operate as the front pair operated in switch position 1. The resistors R7 have no significant effect on this operating mode.

To play quadraphonic sound, the switch 5 is moved to switch position 3 positioning the wipers thereof adjacent contacts as shown in FIG. 1. As can be seen the audio signals are applied to the front speakers through the same paths as outlined with respect to positions 1 and 2. The signal applied to the front speakers runs through the wiper of potentiometer R5, to the high side of the speaker terminals to activate the speaker and then back to ground. This signal includes of course both the in-phase and out-of-phase signal information. But according to the coding method in which the signals are originally matrixed, only the in-phase information in each audio signal should activate the front speaker to which it is applied. Therefore, means comprising resistors R4 are provided coupled between the high sides of the front speakers into which the composite signal is applied, to suppress the out-of-phase back channel information, as will now be explained. It can be seen that the right front speaker and left front speaker respond to the separate in-phase signal components from the right and left amplifier outputs since these components are different signals referenced to ground, as are the front speakers. But the back speaker channel information, which is also supplied to the front speakers is essentially out-of-phase information, i.e. it is a potential between the left hot amplifier input and right hot amplifier input. This would ordinarily produce some response from the front speakers. But this invention provides a trap comprising resistance R4 in series between the left and right hand side speaker terminals. Thus these out-of-phase signal components, applied to the left and right front speaker terminals, being of substantially equal amplitude and opposite phase (according to the matrix technique used in recording the signals), substantially balance each other out and do not activate the front speakers. The resistors R4 thus comprise a trap for the out-of-phase information, shunting substantially all of this information off the front speakers and preventing "muddying" of the output of the front speakers by the out-of-phase information. Instead, the out-of-phase components of the audio signals activates the rear speakers only, as will now be explained, thereby providing accurate reproduction and front-to-rear separation.

The high side of each of the rear speakers is connected to the variable resistance R5 and through the wiper arm thereof to the amplifier outputs. Thus the left and right amplifier audio output signals are applied to the high side of the respective left and right rear speaker inputs. These speakers have their low sides connected together by resistors R7. Because of this connection the in-phase signal components of the audio signals which are referenced to amplifier ground, do not activate the rear speakers except as provided by R3. The rear speakers are activated primarily by the out-of-phase components of the respective signals generated as a potential difference between the left and right high-side speaker inputs.

If resistance R7 were the only significant element in the rear channel, the two back speakers would play common information, because they are connected in series. The result would be a three-channel system (the two front speakers plus a virtual sound source in the rear). To overcome this difficiency, resistor R3 is connected from the center tap of resistors R7 to ground, to serve as a differential element, allowing differing potentials to be developed between the high and ground sides of the rear speakers in response solely to the degree of out-of-phase component of the audio signal applied directly thereto. Resistor R3 provides a return to ground and thus a point of reference for the partially out-of-phase information in each rear speaker circuit. Since the audio signal information in the partially out-of-phase component applied to each speaker is not shared with the other rear speaker, the rear speakers are separately energized, providing full left to right separation and reproduction of the signals as recorded.

Thus considering the overall decoding parameters of this circuit, the two front speakers connected across the amplifier outputs are energized by separate in-phase information signals (left and right), with the out-of-phase information damped out by resistance R4; two back speakers connected in series with the amplifier outputs are differentially energized by the out-of-phase information from these separate signals, because of differential element R3. Thus full front-to-rear and left-to-right separation exists, and the quadraphonic signals are reproduced as recorded.

A further feature of this circuit is the signal dividing ratio control device, resistance R5, from whose high and low ends the front and rear audio signals are applied to the speakers. If the wiper of the ratio control is moved down, this puts the potential input closer to the back speakers. The out-of-phase information activates these two back speakers, but it is further away from the speakers on the front; back channel information applied to the front speakers is trapped out by resistance R4. Also, the back speakers will play louder and the front ones would play softer. As the wiper moves up, and gets closer to the front speaker terminals, the information is more direct and the front speakers play louder; the back speakers, of course, fall off. When the wiper is at the top of resistance R5, the amplifier input is shunted with R4 which is the back channel trap, which continues to reduce back channel information even further. Thus resistance R5 provides a ratio control between front and rear speakers to compensate for variations in program material and location in the listening area. It is not a common living room arrangement to place all the furniture in the center of the room with the speakers in the corner; rather, the sitting arrangement is usually skewed toward one side of the room. In this way, utilizing the ratio control resistor R5, the relative volume of the front and rear speakers may be adjusted by adjusting the proportion of the signal fed to the respective front and rear speaker.

The fourth switch position, the monitor position, is provided to allow a listener to test to determine that out-of phase information is in fact being applied to the speakers. In this switch position, no audio signal information is applied to the high side of the rear speakers and these speakers are silent. The separate audio signals are applied to the high sides of the separate front speakers. But the line 12 normally connecting the low side of these speakers and ground is left in air. Thus the in-phase information coming out of the left and right amplifier outputs has no speaker ground to refer to, and does not activate the speakers. But the center tap of resistors R4 is connected to ground through the wiper of the left front speaker switch and contact 4 thus maintaining aload of the amplifier output. The out-of-phase information, which is an oscillating signal with respect to the left and right sides rather than with respect to ground, is able to activate the left and right front speakers. Effectively in the monitor function means are provided to adapt the back channel trap, resistor R4, to cause the back channel information to be heard on the front speakers, the normal front channel information being removed by removing reference ground from the low side of the speakers. This monitor mode is an important feature in detecting the out-of-phase information which provides the quadraphonic sound effect. The detection of this out-of-phase information serves as a convenient means of evaluating program material for quadraphonic content.

I claim:

1. A decoding network for use in a quadraphonic sound system connected between the left and right outputs of a stereophonic amplifier and at least four acoustic transducers, the respective left and right audio output signals of that amplifier each having signal components in phase with one another and also signal components out of phase with the corresponding signal components of the other, comprising means for applying said left audio output signal from said left amplifier output to a left pair of said acoustic transducers, means for applying said right audio output signal from said right amplifier output to a right pair of said acoustic transducers, means connecting the first of said left pair and the first of said right pair of transducers in series with said left and right amplifier outputs so that said first transducer of each pair responds primarily to the mutually out-of-phase components of the respective applied audio signals, means connecting the second of said left pair and the second of said right pair of transducers respectively across the respective said left and right amplifier outputs, trap means comprising a pair of series connected resistors, said resistors pair being center tapped, and said resistor pair being connected in series between the high sides of only said second left and right transducers, whereby the out-of-phase components of the left and right audio signals substantially cancel each other out and are not reproduced by said second transducers.

a differentiating network coupled between said transducer series connecting means and ground so that each one of said series connected first pair of acoustic transducers is responsive to its out-of-phase component and to a portion of its respective in-phase component of the audio signal applied thereto, and a switch for selectively connecting said resistor center tap to ground, whereby, when the center tap is connected to ground, there is provided an in-phase amplifier load sufficient to permit application of only the out-of-phase signal component and only to said second transducers, without destructive oscillation of the amplifier, such that the presence or absence of such an out-of-phase signal component may be detected.

* * * * *